United States Patent [19]

Satoma

[11] Patent Number: 5,072,678

[45] Date of Patent: Dec. 17, 1991

[54] NEEDLE THREADING APPARATUS FOR A TWO-NEEDLE SEWING MACHINE

[75] Inventor: Shiro Satoma, Chofu, Japan

[73] Assignee: Juki Corporation, Tokyo, Japan

[21] Appl. No.: 661,671

[22] Filed: Feb. 27, 1991

[30] Foreign Application Priority Data

Feb. 28, 1990 [JP] Japan ..... 2-47537

[51] Int. Cl.[5] ..... D05B 87/02

[52] U.S. Cl. ..... 112/225; 112/163

[58] Field of Search ..... 112/224, 225, 163; 223/99

[56] References Cited

U.S. PATENT DOCUMENTS 3,085,527 4/1963 Strausser ..... 112/225
3,485,194 12/1969 Eguchi ..... 112/225
3,517,631 6/1970 Weber ..... 112/225
4,893,573 1/1990 Moriya ..... 112/225

FOREIGN PATENT DOCUMENTS 54-43878 12/1979 Japan .
55-9891 3/1980 Japan .

*Primary Examiner*—Werner H. Schroeder
*Assistant Examiner*—Paul C. Lewis
*Attorney, Agent, or Firm*—Morgan & Finnegan

[57] ABSTRACT

A threading mechanism where a thread catcher hook is reciprocated between two needles by a movable means. Although the two juxtaposed needles are separated horizontally and vertically, position aligning means places the hook opposite either needle eye, thereby facilitating threading both needles and greatly improving sewing efficiency.

5 Claims, 8 Drawing Sheets

(PRIOR ART)

NEEDLE THREADING APPARATUS FOR A TWO-NEEDLE SEWING MACHINE

BACKGROUND OF THE INVENTION

This invention relates to a needle-threading apparatus for a two-needle sewing machine.

Needle-threading is one of the most complicated and labor-intensive operations in sewing. An apparatus as shown in FIG. 6 has previously been proposed for making these operations more convenient and laborsaving.

The needle-threading apparatus shown in FIG. 6 has a frame member F which is mounted on a sewing machine head (not shown). Frame member F is parallel to a needle bar 1, and is vertically and slidably movable.

A loaded tension spring S2 is held in position by fixing its lower end to the frame member F and its upper end to a retainer 5 thereby normally urging frame member F upward. A shaft 2 is rotatably supported on frame member F.

A pin 3 passes through shaft 2 with both ends of the pin extending out on either side of shaft 2. One end of pin 3 is engaged in an oblique slot Fa in frame member F as shown in FIG. 7A.

A coil spring S1 is helically mounted on shaft 2. The upper end of spring S1 presses against frame member F and its lower end presses against pin 3. This pressure on pin 3 urges shaft 2 downward, thereby forcing pin 3 to the lower end position in oblique slot Fa as shown in FIG. 7A.

A stopper 4 is secured to the needle bar 1. When the frame member F is lowered against the bias of spring S2 by pressing on lever L which forms part of frame member F, pin 3 abuts against the top of stopper 4. Further downward movement of frame member F allows pin 3 to slide upward in the oblique slot Fa as shown by the arrow in FIG. 7A, thereby rotating shaft 2.

A thread catcher 6 is provided in the lower portion of shaft 2. Said catcher includes a hook **6*a* and needle holders 6*b*on either side of the hook. The thread catcher 6 is adapted for downward movement and rotation with shaft 2. When pin 3 is in the upper end of oblique slot Fa, shaft 2 cannot rotate and thread catcher 6 thereby engages a needle N on needle bar 1**, as shown in FIG. 7B.

FIG. 7C is a partial side view, in perspective, showing the manner in which thread catcher 6 engages needle N. When pin 3 is in the upper end of slot Fa, hook **6*a* on thread catcher 6 passes through needle eye O of needle N and engages thread. The restoring force of spring S2 then releases frame member F from its downward depression to assume its original position, thereby rotating shaft 2 and removing the now threaded hook 6*a*** through needle eye O.

As aforementioned, the needle threading apparatus is capable of readily and quickly threading needle eye O, thereby improving the sewing operation.

Although the needle-threading apparatus described above may be applied to "one-needle sewing machines", this apparatus is essentially unsuitable for "two-needle sewing machines" where there are not only two needles, N1 and N2, but two needle eyes 01 and 02 which are positioned out of alignment with each other, thereby requiring more space than is here ordinarily available.

For this reason, complicated manual operations are required to thread the two needles, thereby decreasing the efficiency of sewing operations.

OBJECTS OF THE INVENTION

It is therefore an object of the invention to avoid the above disadvantages of the prior art and to provide a needle threading apparatus for a two-needle sewing machine.

SUMMARY OF THE INVENTION

The above and other objects of the invention are met by the disclosed needle-threading apparatus which includes a threading mechanism for a two-needle sewing machine, having a hook which is insertable in the eye of each needle for threading the needles, a movable means for horizontally reciprocating the needle threading mechanism between the juxtaposed needles so as to face the threading hook to either one of the two needles, and a position aligning means for vertically and horizontally moving the hook in the same line as each of the needle eyes of the oppositely arranged needles.

The needle-threading apparatus for the two-needle sewing machine according to the present invention is capable of threading the needles by horizontally reciprocating the needle-threading mechanism to face the threading hook to either one of the two juxtaposed needles, horizontally and vertically moving the hook, and aligning the hook perpendicularly with one of the needle eyes.

BRIEF DESCRIPTION OF THE DRAWINGS

The invention is described, by way of example only, with reference to the accompanying drawings, in which.

DETAILED DESCRIPTION OF THE DRAWINGS

Figure 1:
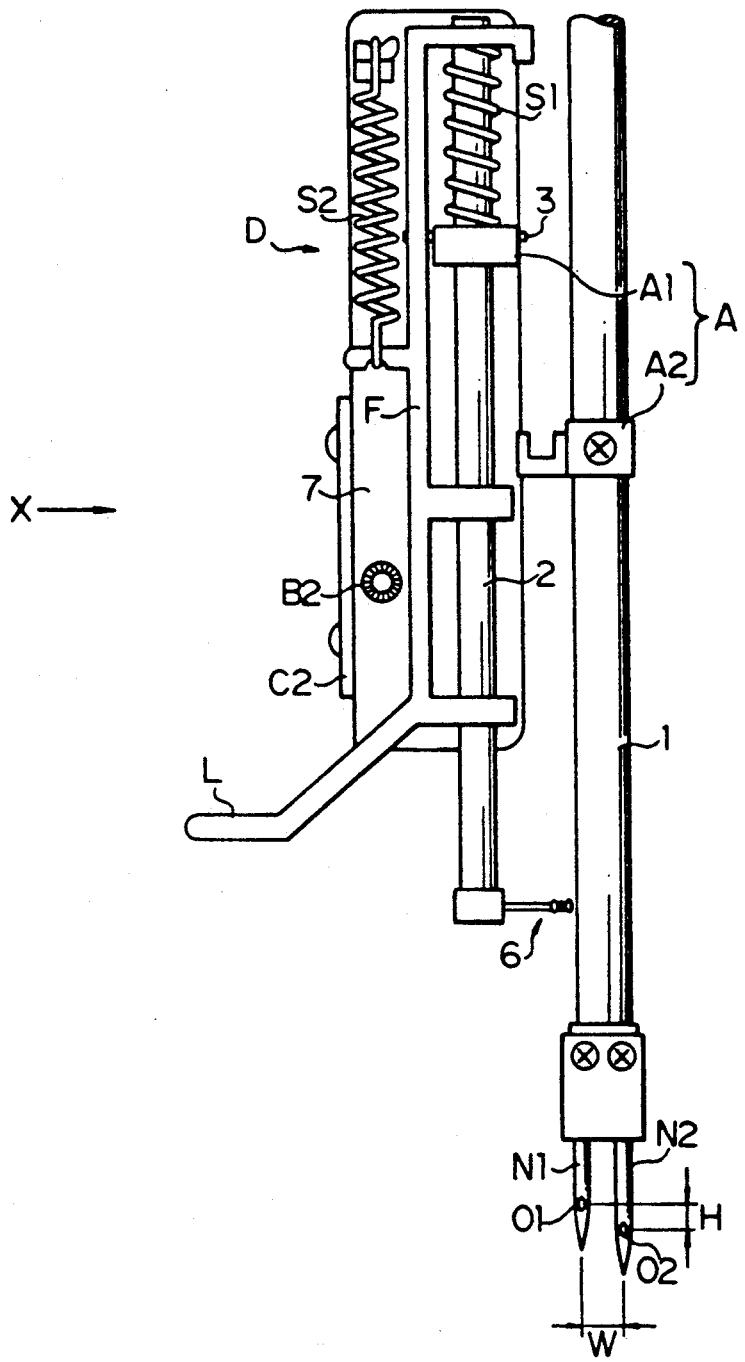
FIG. 1 is a plan view showing one embodiment of a threading apparatus for a two-needle sewing machine according to the invention.

FIGS. 1-5 show a preferred embodiment of the present invention, wherein like reference numerals designate like or corresponding parts throughout the several views. Therefore, only one detailed description of similar parts is given.

Figure 7A:
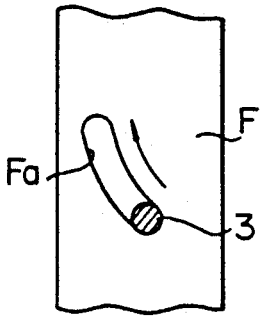
FIG. 7A is a plan view showing the manner in which a pin engages an oblique slot and how the pin slides through the slot.
Figure 7B:
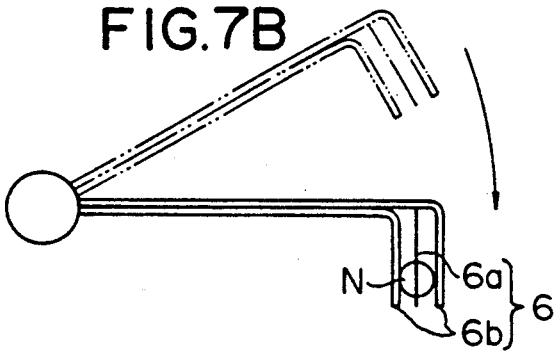
FIG. 7B is a plan view explaining the manner in which the thread catcher engages a needle.
Figure 7C:
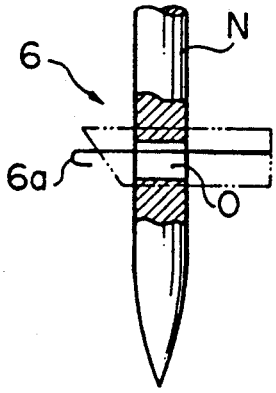
FIG. 7C is a partial side view, in perspective, showing the manner in which the thread catcher engages with a needle.
Figure 8:
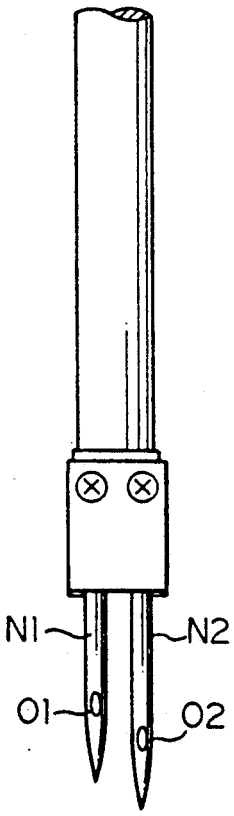
FIG. 8 is a partial side view, in perspective, showing the two needles used with the two-needle sewing machine.

FIG. 1 is a plan view showing a needle threading apparatus for a two-needle sewing machine. Character D designates a needle-threading mechanism which includes a frame member F, a rotary shaft 2 and a conventional thread catcher 6. These parts are lowered by pressing a lever L, thereby allowing a pin 3 extended through shaft 2 to slide along an oblique slot Fa formed in the frame member F (see FIGS. 7A, 7B) so that the thread catcher 6 may be rotated in the direction of needles N1 and N2.

A mounting plate 7 provides the support for needle-threading mechanism D and also vertically and slidably supports frame member F. Plate 7 is also adapted to hold the upper end of a first spring S2 which provides bias to upwardly urge frame member F.

A needle bar 1 for use with a two-needle sewing machine is provided with first and second needles N1 and N2 which are horizontally spaced a distance W apart. Needles Nl and N2 have eyes 01 and 02 which are vertically out of alignment with each other by a distance H.

A movable mechanism including rotary portion C and a locking portion B will be explained by reference to FIGS. 2 and 3.

Figure 2:
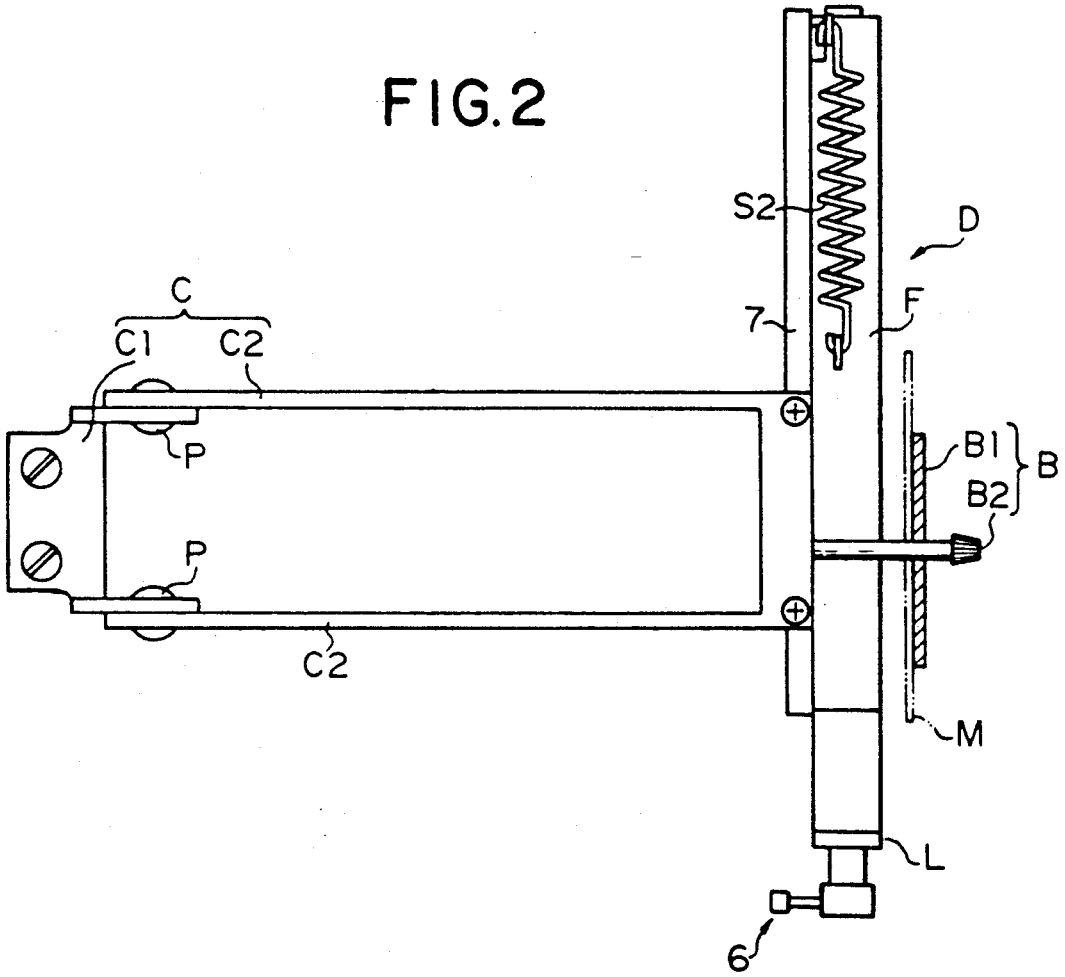
FIG. 2 is a side elevation of the two-needle threading apparatus shown in FIG. 1.

FIG. 2 is a view of the threading apparatus for the two-needle sewing machine when looking in the direction of X in FIG. 1. The rotary portion C includes a block Cl that is secured to the frame of the sewing machine, and a rotary arm C2 rotatably supported by a pin P on block C1. The rotary arm C2 supports mounting plate 7 secured thereto. The rotary portion C is capable of horizontally rotating the threading mechanism.

Figure 3A:
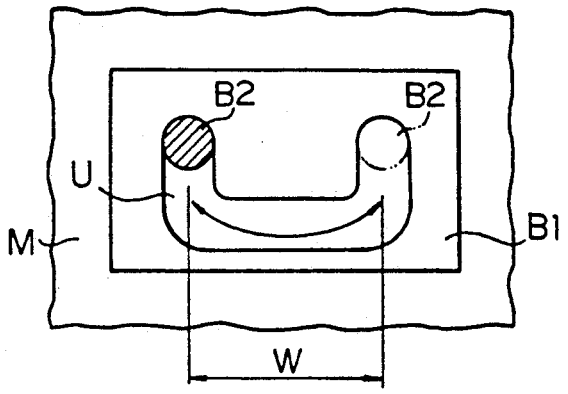
FIG. 3A is a plan view showing the manner in which a cylindrical rod is in engagement with a dimension limiting panel.

The locking portion B includes a cylindrical rod B2 and a tenter B1. The cylindrical rod B2 is formed of elastic material and is mounted on the mounting plate 7. As shown in FIG. 3A, cylindrical rod B2 passes through a U-shaped orifice U of tenter B1 which is fixed to the sewing machine frame M. Tenter B1 allows cylindrical rod B2 to move in orifice U over a distance W.

Figure 3B:
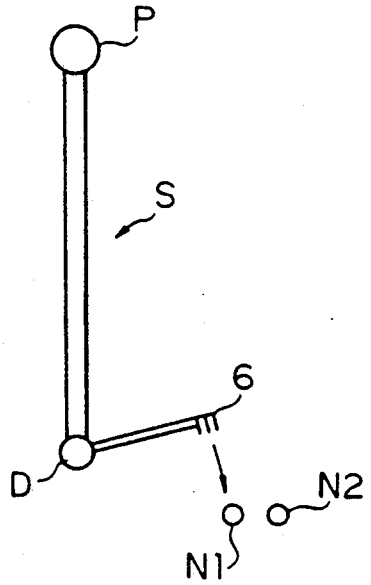
FIGS. 3B, and 3C are views showing a sequence of movement of the needle-threading mechanism by a movable means.
Figure 3C:
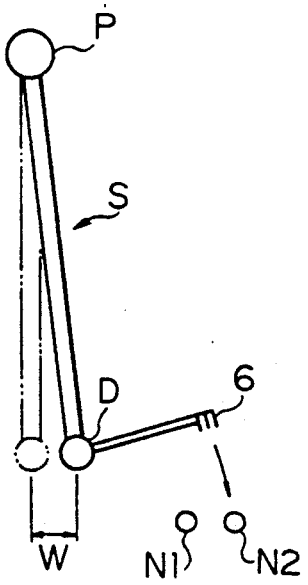

In other words, locking portion B causes the threading mechanism D to move over the distance W. Placing cylindrical rod B2 in the leftmost position, shown in solid lines in FIG. 3A, allows thread catcher 6 of the threading mechanism D to engage the first needle N1, as shown in FIG. 3B. On the other hand, placing the cylindrical rod B2 in the rightmost position, shown in dotted lines in FIG. 3A, allows thread catcher 6 to engage the second needle N2, as shown in FIG. 3C.

A position aligning portion will be detailed hereinafter. In FIG. 1, character A designates a position aligning portion which includes an annular member A1 mounted on the rotary shaft 2 of the threading mechanism D and a retainer A2 disposed on the needle bar 1.

Figure 4:
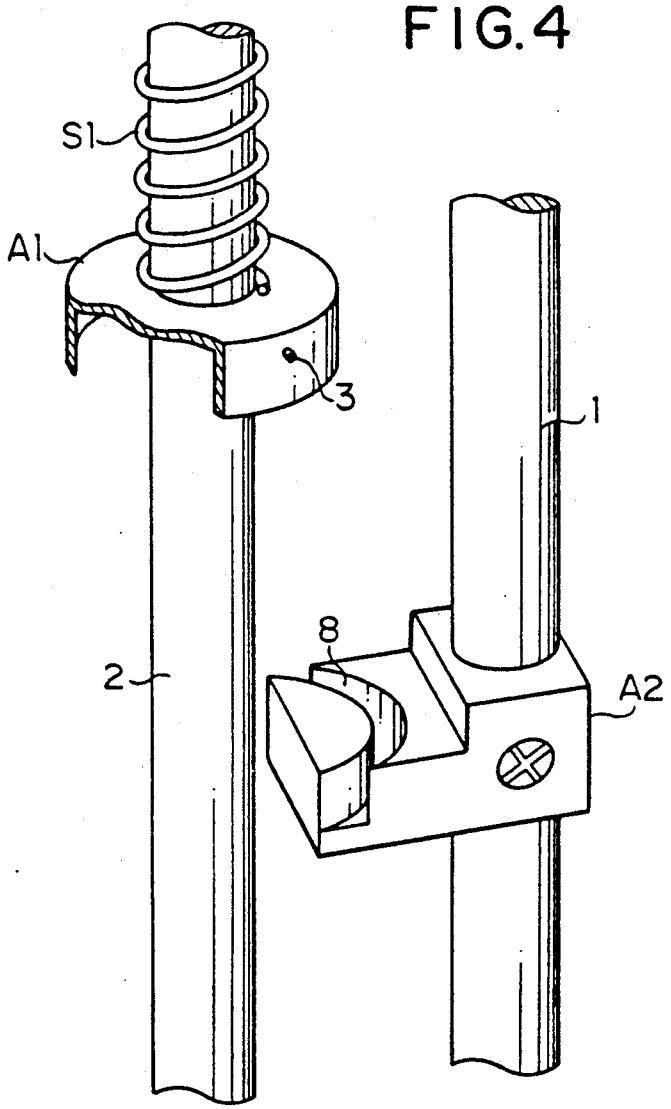
FIG. 4 is a perspective and partly broken away view showing the details of an aligning means.

FIG. 4 is a perspective and partly broken away view showing the arrangement of the position aligning portion. As shown, annular member A1 has a cap shape and is rigidly mounted on rotary shaft 2. Annular member A1 includes a pin 3 which passes through both annular member A1 and shaft 2, and annular member A1 is adapted for downward movement and rotation with pin 3.

Although the embodiment has been described with respect to pin 3 which passes through the annular member A1, annular member A1 may be mounted upon rotary shaft 2 without use of such a pin.

Retainer A2 is formed with a semi-cylindrical recess 8 and is secured downward of annular member A1 on needle bar 1. The depth of recess 8 is equal to the difference H in the vertical displacement level of the two needles. Downward movement of the lever L allows annular member A1 to abut against retainer A2. A further downward movement of lever L causes pin 3 to slide along the oblique slot Fa and thereby rotate shaft 2 (see FIG. 7A).

Figure 5A:
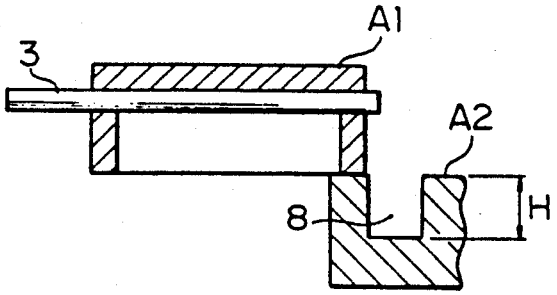
FIG. 5A is a sectional view showing the manner in which an annular member abuts against the top of a retainer.
Figure 5B:
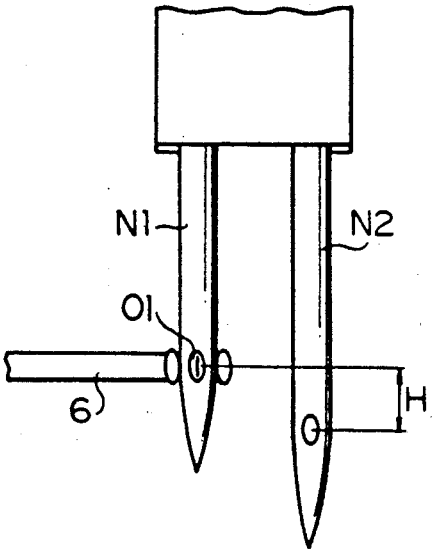
FIG. 5B is a perspective view showing the manner in which the thread catcher engages a first needle.

When annular member A1 abuts against the top of retainer A2, as shown in FIG. 5A, threading mechanism D engages the first needle N1, as shown in FIG. 5B. Thus, when annular member A1 is held at the height as shown in FIG. 5A, thread catcher 6 is at the same height as needle eye 01 of the first needle N1, as seen in FIG. 5B and the first needle N1 can be threaded by means of the thread catcher 6.

Figure 5C:
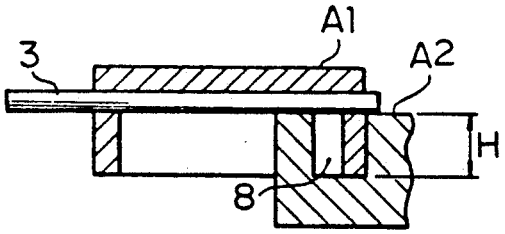
FIG. 5C is a sectional view showing the manner in which the annular member is accommodated in a recess in the retainer.
Figure 5D:
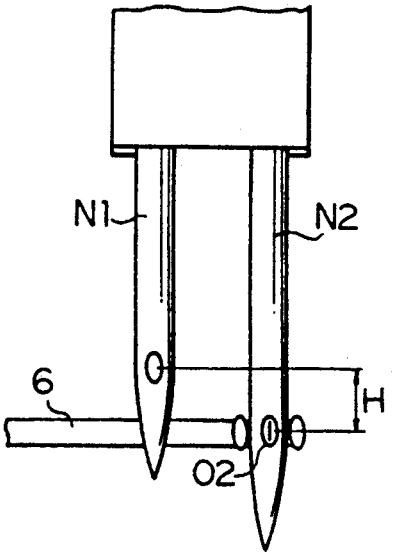
FIG. 5D is a perspective view showing the manner in which the thread catcher engages a second needle.
Figure 6:
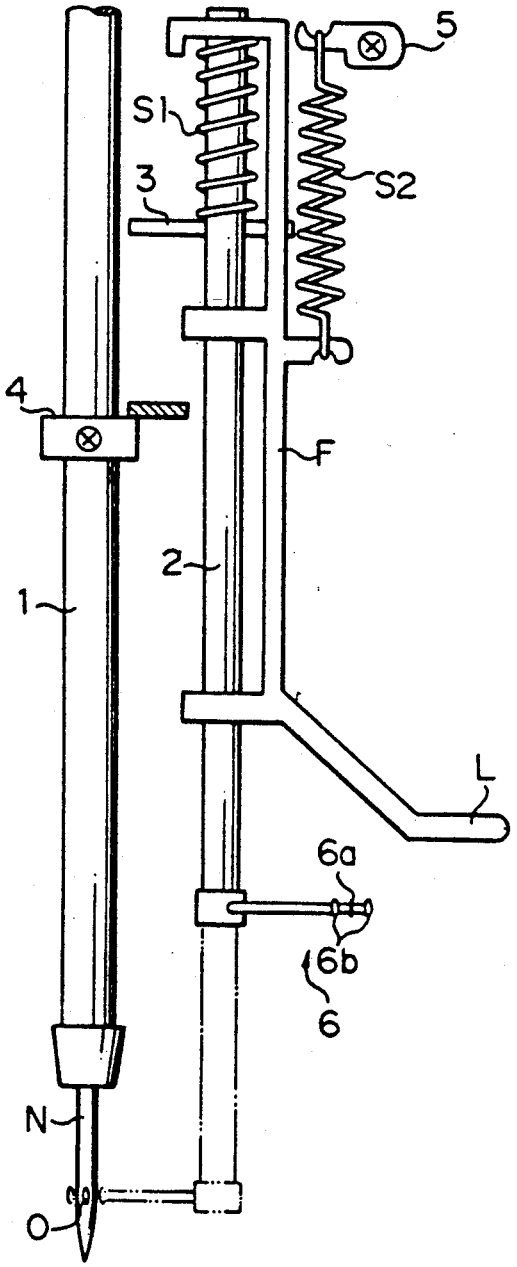
FIG. 6 is a representation of a needle-threading apparatus which has been heretofore proposed.

On the other hand, when annular member A1 abuts retainer A2 within recess 8, as shown in FIG. 5C, threading mechanism D engages the second needle N2, as shown in FIG. 5D. As shown in FIG. 5C, the retainer A2 is lowered by the difference (height) H from the position shown in FIG. 5A.

Thus, thread catcher 6 will be at the same height as needle eye 02 in second needle N2, as seen in FIG. 5D so that the second needle N2 can be threaded by means of the thread catcher 6.

According to the invention, the threading apparatus for the two-needle sewing machine includes a threading mechanism with a hook, a movable portion for reciprocating the threading mechanism between two juxtaposed needles, and a position aligning portion for maneuvering the threading hook opposite to each of the needle eyes at different heights, thereby facilitating threading the respective needles and greatly improving sewing efficiency.

Although the invention has been described in detail herein by way of reference to the disclosed embodiments, it should be understood that the invention is not limited to the disclosed embodiments, but should be interpreted in accordance with the claims which follow.

We claim:

1. A needle threading apparatus for a two-needle sewing machine comprising:

a needle bar having a first needle and a second needle disposed horizontally apart from said first needle;

a threading mechanism having a rotary shaft, a hook secured to said rotary shaft for threading said needles, and a mounting for supporting said rotary shaft so that said rotary shaft rotates and moves vertically;

means for reciprocating said threading mechanism in a horizontal direction between a first horizontal position where said hook opposes said first needle and a second horizontal position where said hook opposes said second needle; and means for positioning said hook in a vertical direction along a line passing a needle hole of said opposed needle so that said hook may selectively oppose one of the needle holes of said needles.

2. A needle threading apparatus for a two-needle sewing machine according to claim 1 wherein said reciprocating means comprises a rotary arm for moving said threading mechanism in a horizontal direction, and a locking member for locking said rotary shaft in a first or second position.

3. A needle threading apparatus for a two-needle sewing machine according to claim 2 wherein:

said rotary arm comprises one end pivotally supported on a sewing machine frame and the other end connected to said threading mechanism; and said locking member comprises a cylinder connected to said other end of said rotary arm, and a plate fixed to said sewing machine frame, said plate including a groove for limiting movement of said cylinder within a predetermined range.

4. A needle threading apparatus for a two-needle sewing machine according to claim 1 wherein:

said positioning means comprises an abutting member secured to said rotary shaft and a retainer secured to said needle bar;

said mounting comprises a lever for pushing down said rotary shaft, a spring positioned between said lever and said rotary shaft, and guide means for rotating said rotary shaft; and said abutting member and said retainer have a configuration such that the abutting member may selectively abut on said retainer in two vertical positions, said hook being able to oppose said first needle hole at a first vertical position and said hook being able to oppose said second needle hole at a second vertical position.

5. A needle threading apparatus for a two-needle sewing machine according to claim 4, wherein said guide means rotates said rotary shaft after said abutting member abuts against said retainer so that said hook threads said needle.

* * * * *